United States Patent [19]

Hershfeld

[11] Patent Number: 4,699,601

[45] Date of Patent: Oct. 13, 1987

[54] BUILDING BLOCK TOY

[75] Inventor: Uri Hershfeld, Merom Hagalil, Israel

[73] Assignee: Orda Industries (1969) Ltd., Hagalil, Israel

[21] Appl. No.: 866,718

[22] Filed: May 27, 1986

[30] Foreign Application Priority Data

Jun. 7, 1985 [IL] Israel ..... 75444

[51] Int. Cl.[4] ..... A63H 33/00; A63H 33/04

[52] U.S. Cl. ..... 446/69; 446/117

[58] Field of Search ..... 446/117, 69, 487, 476

[56] References Cited

U.S. PATENT DOCUMENTS

| | | | |
|---|---|---|---|
| 264,066 | 9/1882 | Crandall | 446/117 X |
| 2,278,894 | 4/1942 | Paulson | 446/117 |
| 3,407,514 | 10/1968 | Christian | 446/69 X |
| 3,946,516 | 3/1976 | Wirth | 446/117 |
| 4,203,525 | 5/1980 | Okubo | 446/117 X |

FOREIGN PATENT DOCUMENTS

| | | | |
|---|---|---|---|
| 1523814 | 9/1978 | United Kingdom | 446/117 |

*Primary Examiner*—Philip C. Kannan

*Attorney, Agent, or Firm*—Benjamin J. Barish

[57] ABSTRACT

A toy comprises a set of building blocks of progressively-decreasing sizes each of hollow configuration and open at its opposite ends. Each block is formed with an outwardly-extending peripheral flange at one end and an inwardly-extending peripheral flange at its opposite end, the dimensions of the blocks and flanges being such as to permit them to be assembled in a configuration wherein the blocks increase in size or in another configuration wherein they decrease in size.

11 Claims, 5 Drawing Figures

BUILDING BLOCK TOY

BACKGROUND OF THE INVENTION

The present invention relates to toys, and particularly to a building-block type toy which permits the building blocks to be assembled according to various configurations.

A number of such building block toys are now available. An object of the present invention is to provide a new toy of the building-block type which is of very simple construction and permits assembly according to two basically different configurations.

SUMMARY OF THE INVENTION

According to a broad aspect of the present invention, there is provided a toy comprising a set of building blocks including a plurality of blocks of progressively-decreasing sizes. Each of the plurality of blocks is of hollow configuration and open at its opposite ends, and each is formed with an outwardly-extending peripheral flange at one end and an inwardly-extending peripheral flange at its opposite end. The inner transverse dimensions of the inwardly-extending peripheral flange of each of the plurality of blocks are greater than the outer transverse dimensions of the next smaller-size block of the plurality, but less than the outer transverse dimensions of the outwardly-extending peripheral flange of the next smaller-size block of the plurality. The outer transverse dimensions of the outwardly-extending peripheral flange of each block of the plurality are less than the inner transverse dimensions of the next larger size block of the plurality. The arrangement is such that the blocks may be assembled together according to either of the following two configurations:

(1) a first configuration wherein the largest size block is placed on a horizontal supporting surface with its outwardly-extending peripheral flange facing downwardly, and each of the other blocks is applied thereover in size-decreasing sequence with the outwardly-extending peripheral flange facing downwardly and supported by the inwardly-extending peripheral flange of the underlying block to produce a self-supporting tower having a height equal to the sum of the length of all the blocks; or (2) a second configurations in which the largest size block is placed on a horizontal supporting surface with its inwardly-extending peripheral flange facing downwardly, and each of the other blocks is disposed within it in size-decreasing sequence with the inwardly-extending peripheral flange facing downwardly to produce a nested assembly of all the blocks nested within each other and having an overall height equal only to that of the largest size block, said nested assembly being expandable to a height equal to the sum of the lengths of all the blocks by lifting the largest size block from the horizontal supporting surface until the inwardly-extending peripheral flange of each block engages and supports the outwardly-extending peripheral flange of the next size block in the nested assembly.

In the preferred embodiment of the invention described below, the set of blocks includes a further end block of smaller size than the smallest size block in the mentioned plurality of blocks, this further block also being of hollow construction but closed at one end and open at its opposite end; this further block also including an outwardly extending peripheral flange at its open end, which flange has outer transverse dimensions smaller than the outer transverse dimensions of the smallest size block in the mentioned plurality, but larger than the transverse dimensions of the outwardly-extending peripheral flange of the smallest size block in the mentioned plurality.

Preferably, each of the blocks of the set is of cylindrical configuration, but it is contemplated that the blocks may be of other configurations, for example of square, pentagonal, hexagonal, or other polygonal cross-section.

BRIEF DESCRIPTION OF THE DRAWINGS

Further features and advantages of the invention will be apparent from the description below.

The invention is herein described, by way of example only, with reference to the accompanying drawings, wherein.

DESCRIPTION OF A PREFERRED EMBODIMENT

Figure 1:
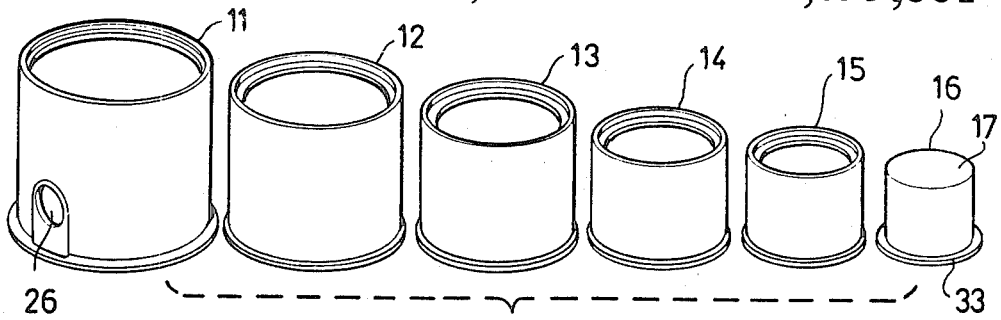
FIG. 1 illustrates one set of building blocks constructed in accordance with the present invention.

The set of building blocks illustrated in FIG. 1 comprises five blocks 11–15, respectively, of progressively-decreasing sizes and of substantially the same configuration and construction but differing merely in dimensions. The five blocks 11–15 are all of cylindrical configuration open at their opposite ends.

The set illustrated in FIG. 1 includes a sixth block 16 of smaller size than block 15. Block 16 is also of cylindrical configuration, but one end is closed by a top wall 17; its opposite end is open as in blocks 11–15.

Figure 2:
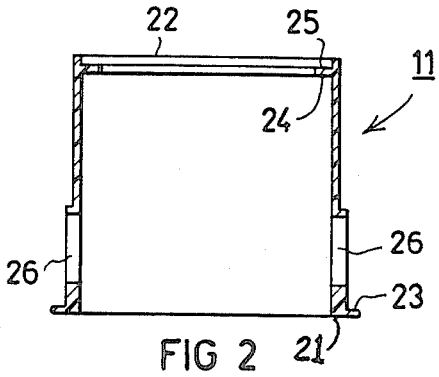
FIG. 2 is a cross-sectional view of the largest block in the set of FIG. 1.

FIG. 2 illustrates the construction of the largest-size block 11. It is of cylindrical configuration and is open at its two opposite ends, as mentioned above. Block 11 is slightly conical having a larger diameter at one end 21, constituting the bottom of the block, than at its opposite end 22, constituting the top. The bottom end 21 of the block is formed with an outwardly-extending peripheral or annular flange 23; and the top end 22 is formed with an inwardly-extending peripheral or annular flange 24. The latter flange 24 is formed slightly inwardly of the outer edge of the block so as to define an annular recess 25.

Block 11 is formed with a pair of openings 26 at diametrically opposed portions of the block adjacent to end 24 formed with the outwardly-extending flange 23.

Blocks 12–15 are all of identical construction as block 11, except that they are not formed with openings 26; they also differ in dimensions, both in height and in diameter, from block 11, blocks 12–15 progressively decreasing in both height and diameter.

The end block 16 is of similar construction as blocks 11–15. Thus, block 16 is also of cylindrical configuration and is slightly conical so as to decrease in diameter from its bottom to its top. Block 16 is of slightly smaller dimensions than block 15 both in diameter and in height, but it does not include the inwardly-extending annular flange at the top (smaller-diameter) end of the block, as in blocks 11–15, this end of the block being closed by end wall 17. Block 16, however, does include the outwardly-extending annular flange 33 at the larger-diameter end, as shown in FIG. 1.

Flange 24 of block 11, and the corresponding flanges in blocks 12–15, each have an inner diameter which is greater than the outer diameter of the next smaller size block of the set, but less than the outer diameter of flange 23 of the next smaller size block. In addition, the outwardly-extending flanges in blocks 12–16, corresponding to flange 23 in block 11, are each of an outer diameter which is less than the inner diameter of the next larger-size block in the set.

Figure 5:
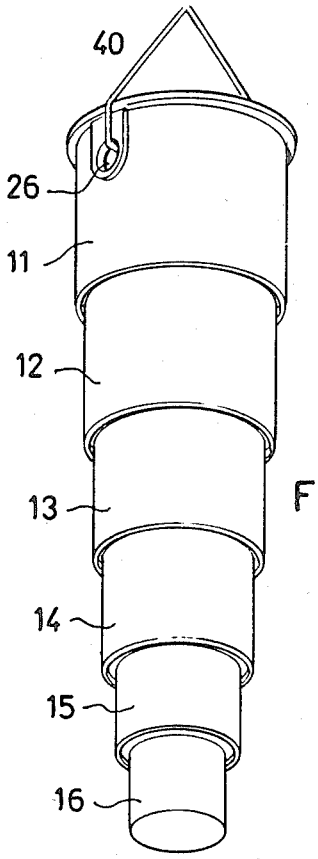
FIGS. 4 and 5 illustrate a second configuration in which the blocks of FIG. 1 may be assembled, FIG. 4 showing the initial nested configuration of the assembly, and FIG. 5 showing the expanded configuration of the assembly of FIG. 4.
Figure 3:
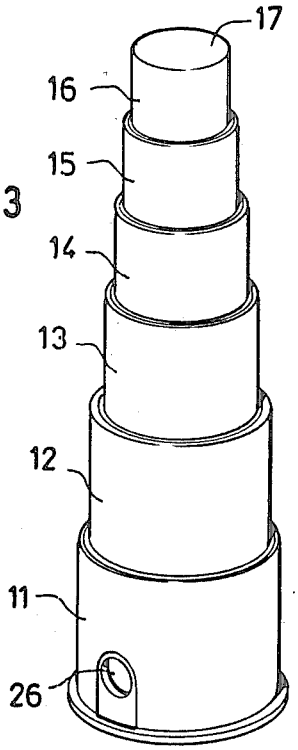
FIG. 3 illustrates one configuration in which the building blocks of FIG. 1 may be assembled.
Figure 4:
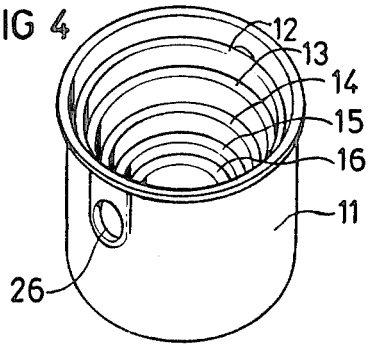

The foregoing constructional features of blocks 11–16 enable the blocks to be assembled according to two different configurations; one configuration is illustrated in FIG. 3; and the other configuration is illustrated in FIGS. 4 and 5, FIG. 4 showing the initial form of that configuration, and FIG. 5 showing the expanded form thereof.

Thus, in order to assemble the blocks according the configuration illustrated in FIG. 3, the largest size block 11 is placed on a horizontal supporting surface, such as a table or the floor, with the outwardly-extending flange 23 facing downwardly and therefore in contact with the supporting surface. Block 12 is then placed on top of block 11, with the outwardly-extending flange of block 12 (corresponding to flange 23 of block 11) being received within the annular recess 25 defined by the inwardly-extending annular flange 24 at the opposite end of block 11. The other blocks 13, 14, 15 and 16 are then applied in the same manner, one on top of the other, with the outwardly-extending annular flange (corresponding to flange 23 in block 11) being seated in the annular recess defined by the inwardly-extending flange (corresponding to flange 24 in block 11) of the underlying block. As indicated above, block 16 is not formed with an inwardly-extending flange, since it constitutes the end block of the stacked array, but rather, that end of the block 16 is closed by an end wall 17.

It will thus be seen that the blocks 11–16 assembled according to the configuration illustrated in FIG. 3 produce a self-supporting tower having a height equal to the sum of the lengths of all the blocks 11–16.

In order to produce the second configuration, the largest size block 11 is placed on the horizontal supporting surface with the inwardly-extending flange 24 facing downwardly. The remaining blocks 12–16 are then placed within block 11, one after the other in size-decreasing sequence, with the inwardly-extending flange 24 of each such block also facing downwardly. Thus, all the block are nested within each other to produce the nested assembly illustrated in FIG. 4, wherein the overall height of the nested assembly is equal merely to the height of the largest size block 11.

The nested assembly illustrated in FIG. 4 may then be expanded by lifting block 11 from the horizontal supporting surface, until its inwardly-extending flange 24 engages the outwardly-extending flange (corresponding to flange 23) of the next size block 12. Further lifting of block 11 also raises with it block 12, until its inwardly-extending flange of block 12 engages and supports the outwardly-extending flange of the next smaller block 13. Further raising block 11 will produce a similar action with respect to the remaining blocks 14, 15 and 16, until the expanded configuration illustrated in FIG. 5 is produced. This expanded assembly will thus have a length substantially equal to the sum of the lengths of all the blocks, less the small distances at which the inwardly directed annular flanges, corresponding to flange 24 in block 11, are spaced from their respective ends of the blocks.

String 40 or other suspension means may be passed through openings 26 in block 11, when the blocks are in the nested assembly illustrated in FIG. 4, to facilitate expanding the assembly to the configuration illustrated in FIG. 5, and also to suspend the expanded assembly from a support.

Preferably, the blocks are made of differently-colored plastic material.

While the invention has been described with respect to one preferred embodiment, it will be appreciated that many other variations, modifications and configurations of the invention may be made.

What is claimed is:

1. A toy comprising:

a set of building blocks including a plurality of blocks of progressively-decreasing sizes;

each of said plurality of blocks being of hollow configuration and open at its opposite ends;

each of said plurality of blocks being formed with an outwardly-extending peripheral flange at one end around the complete periphery of the block, and an inwardly-extending peripheral flange at its opposite end around the complete periphery of the block;

the inner transverse dimensions of the inwardly-extending peripheral flange of each of said plurality of blocks being greater than the outer transverse dimensions of the next smaller-size block of the plurality, but less than the outer transverse dimensions of the outwardly-extending peripheral flange of the next smaller-size block of the plurality; and the outer transverse dimensions of the outwardly-extending peripheral flange of each block of the plurality being less than the inner transverse dimensions of the next larger size block of the plurality, such that the blocks may be assembled together according to either of two configurations, as follows:

(1) a first configuration wherein the largest size block is placed on a horizontal supporting surface with its outwardly-extending peripheral flange facing downwardly, and each of the other blocks is applied thereover in size-decreasing sequence with the outwardly-extending peripheral flange facing downwardly and supported by the inwardly-extending peripheral flange of the underlying block to produce a self-supporting tower having a height equal to the sum of the length of all the blocks; or (2) a second configuration in which the largest size block is placed on a horizontal supporting surface with its inwardly-extending peripheral flange facing downwardly and each of the other blocks is disposed within it in size-decreasing sequence with the inwardly-extending peripheral flange facing downwardly to produce a nested assembly of all the blocks nested within each other and having an overall height equal only to that of the largest size block, said nested assembly being expandable to a height equal to the sum of the lengths of all the blocks by lifting the largest size block from the horizontal supporting surface until the inwardly-extending peripheral flange of each block engages and supports the outwardly-extending peripheral flange of the next size block in the nested assembly;

the inwardly-extending peripheral flange of each block in said plurality being spaced slightly inwardly of its outer edge to define a peripheral recess extending completely around the periphery of the block for receiving the outwardly-extending peripheral flange of the next overlying block when the blocks are assembled according to said first configuration.

2. The toy according to claim 1, wherein said set of blocks includes a further end block of smaller size than the smallest size block in said plurality of blocks, said further block also being of hollow construction but closed at one end and open at its opposite end; said further block including an outwardly extending peripheral flange at its open end, which flange has outer transverse dimensions smaller than the outer transverse dimensions of the smallest size block in said plurality, but larger than the transverse dimensions of the outwardly-extending peripheral flange of the smallest size block in said plurality.

3. The toy according to claim 1, wherein each block in the set is of decreasing transverse dimensions which are largest at its end formed with the outwardly-extending peripheral flange.

4. The toy according to claim 1, wherein said blocks of the set are also of decreasing lengths.

5. The toy according to claim 1, wherein the largest size block is formed with a pair of transverse openings adjacent to its outwardly-extending peripheral flange to permit suspension of the blocks when assembled according to said second configuration to form said expanded assembly.

6. The toy according to claim 1, wherein each of said blocks is of cylindrical configuration, and said flanges formed thereon are of annular configuration.

7. A toy comprising:

a set of building blocks including a plurality of cylindrical blocks of progressively-decreasing diameters and lengths;

each of said plurality of blocks being of hollow configuration and open at its opposite ends;

each of said plurality of blocks being formed with an outwardly-extending annular flange at one end around the complete periphery of the block and an inwardly-extending annular flange at its opposite end around the complete periphery of the block;

the inner diameter of the inwardly-extending annular flange of each of said plurality of blocks being greater than the outer diameter of the next smaller-size block of the plurality, but less than the outer diameter of the outwardly-extending annular flange of the next smaller-size block of the plurality, and the outer diameter of the outwardly-extending annular flange of each block of the plurality being less than the inner diameter of the next larger size block of the plurality, such that the blocks may be assembled together according to either of two configurations, as follows:

(1) a first configuration wherein the largest size block is placed on a horizontal supporting surface with its outwardly-extending annular flange facing downwardly, and each of the other blocks is applied thereover in size-decreasing sequence with the outwardly-extending annular flange facing downwardly and supported by the inwardly-extending annular flange of the underlying block to produce a self-supporting tower having a height equal to the sum of the length of all the blocks; or (2) a second configuration in which the largest size block is placed on a horizontal supporting surface with its inwardly-extending annular flange facing downwardly and each of the other blocks is disposed within it in size-decreasing sequence with the inwardly-extending annular flange facing downwardly to produce a nested assembly of all the blocks nested within each other and having an overall height equal only to that of the largest size block, said nested assembly being expandable to a height equal to the sum of the lengths of all the blocks by lifting the largest size block from the horizontal supporting surface until the inwardly-extending annular flange of each block engages and supports the outwardly-extending annular flange of the next size block in the nested assembly;

the inwardly-extending peripheral flange of each block in said plurality being spaced slightly inwardly of its outer edge to define a peripheral recess extending completely around the periphery of the block for receiving the outwardly-extending peripheral flange of the next overlying block when the blocks are assembled according to said first configuration.

8. The toy assembly according to claim 7, wherein said set of blocks includes a further end block of smaller size than the smallest size block in said plurality of blocks, said further block also being of hollow cylindrical construction but closed at one end and open at its opposite end; said further block including an outwardly extending annular flange at its open end, which flange has an outer diameter smaller than the outer diameter of the smallest size block in said plurality, but larger than the outer diameter of the outwardly-extending annular flange of the smallest size block in said plurality.

9. The toy according to claim 7, wherein each block in the set is of decreasing diameter which is largest at its outwardly-extending annular flange.

10. The toy according to claim 7, wherein said blocks of the set are also of decreasing lengths.

11. The toy according to claim 7, wherein the largest size block is formed with a pair of transverse openings adjacent to its outwardly-extending annular flange to permit suspension of the blocks when assembled according to said second configuration to form said expanded assembly.

* * * * *